US008152476B2

(12) United States Patent
Babicki et al.

(10) Patent No.: US 8,152,476 B2
(45) Date of Patent: Apr. 10, 2012

(54) POSITIVE DISPLACEMENT PUMP WITH A WORKING FLUID AND LINEAR MOTOR CONTROL

(75) Inventors: Matthew Babicki, West Vancouver (CA); Steven Noble, West Vancouver (CA)

(73) Assignee: Toyo Pumps North America Corp., Burnaby, British Columbia (CA)

( * ) Notice: Subject to any disclaimer, the term of this patent is extended or adjusted under 35 U.S.C. 154(b) by 787 days.

(21) Appl. No.: 11/895,442

(22) Filed: Aug. 24, 2007

(65) Prior Publication Data

US 2009/0053074 A1 Feb. 26, 2009

(51) Int. Cl.
*F04B 49/00* (2006.01)
*F04B 9/113* (2006.01)
*F04B 45/06* (2006.01)

(52) U.S. Cl. ..... 417/46; 417/383; 417/44.1; 417/418; 417/478

(58) Field of Classification Search ..... 417/63, 417/246, 339, 383, 385, 390, 46, 418, 478, 417/44.1; 222/1
See application file for complete search history.

(56) References Cited

U.S. PATENT DOCUMENTS

| | | | | | |
|---|---|---|---|---|---|
| 2,961,966 | A | | 11/1960 | Zillman et al. | |
| 3,551,076 | A | * | 12/1970 | Wilson | 417/385 |
| 3,609,067 | A | | 9/1971 | Wright | |
| 3,770,169 | A | * | 11/1973 | Roach | 222/309 |
| 3,902,826 | A | | 9/1975 | Nagel et al. | |
| 3,951,572 | A | * | 4/1976 | Ray et al. | 417/389 |
| 3,990,815 | A | * | 11/1976 | DeVial | 417/326 |
| 4,178,133 | A | | 12/1979 | Rawicki | |
| 4,439,112 | A | * | 3/1984 | Kitsnik | 417/383 |
| 4,580,952 | A | | 4/1986 | Eberle | |
| 4,687,054 | A | * | 8/1987 | Russell et al. | 166/66.4 |
| 4,787,211 | A | * | 11/1988 | Shaw | 62/117 |
| 4,934,906 | A | * | 6/1990 | Williams | 417/388 |
| 4,990,058 | A | * | 2/1991 | Eslinger | 417/46 |
| 5,049,046 | A | | 9/1991 | Escue et al. | |
| 5,056,036 | A | * | 10/1991 | Van Bork | 700/282 |
| 5,179,306 | A | | 1/1993 | Nasar | |
| 5,252,043 | A | | 10/1993 | Bolding et al. | |
| 5,667,368 | A | | 9/1997 | Augustyn et al. | |
| 5,734,209 | A | | 3/1998 | Hallidy | |
| 5,766,357 | A | * | 6/1998 | Packer et al. | 118/420 |
| 5,831,353 | A | | 11/1998 | Bolding et al. | |
| 5,924,975 | A | * | 7/1999 | Goldowsky | 600/16 |
| 6,017,198 | A | | 1/2000 | Traylor et al. | |
| 6,074,170 | A | * | 6/2000 | Bert et al. | 417/44.2 |
| 6,174,136 | B1 | * | 1/2001 | Kilayko et al. | 417/44.1 |

(Continued)

FOREIGN PATENT DOCUMENTS

CA 2237612 A1 5/1997

(Continued)

*Primary Examiner* — Charles Freay
*Assistant Examiner* — Nathan Zollinger
(74) *Attorney, Agent, or Firm* — Laurence C. Bonar

(57) ABSTRACT

The present invention relates to positive displacement pumps, and particularly to diaphragm positive displacement pumps. An inventive diaphragm positive displacement pump is provided comprising at least one pumping chamber containing a deformable hose diaphragm, a working fluid cylinder fluidly connected to the deformable hose diaphragm, and at least one linear motor to displace the working fluid within the working fluid cylinder and thereby increase and decrease the volume of the pumping chamber. An inventive method of controlling an inventive diaphragm positive displacement pump comprising at least one pumping chamber and powered by at least one linear motor is also provided.

18 Claims, 9 Drawing Sheets

U.S. PATENT DOCUMENTS

| | | | | |
|---|---|---|---|---|
| 6,190,136 | B1 | 2/2001 | Meloche et al. | |
| 6,250,502 | B1 * | 6/2001 | Cote et al. | 222/1 |
| 6,264,432 | B1 * | 7/2001 | Kilayko et al. | 417/44.1 |
| 6,283,720 | B1 | 9/2001 | Kottke | |
| 6,302,660 | B1 * | 10/2001 | Kurita et al. | 417/383 |
| 6,348,124 | B1 * | 2/2002 | Garbett et al. | 156/345.12 |
| 6,506,030 | B1 | 1/2003 | Kottke | |
| 6,595,280 | B2 | 7/2003 | Traylor | |
| 6,817,409 | B2 | 11/2004 | Howard | |
| 6,904,982 | B2 * | 6/2005 | Judge et al. | 175/213 |
| 6,941,853 | B2 | 9/2005 | Hembree | |
| 7,000,455 | B2 | 2/2006 | Stritzelberger | |
| 7,004,727 | B2 | 2/2006 | Kline et al. | |
| 7,090,474 | B2 | 8/2006 | Lehrke et al. | |
| 7,225,946 | B2 * | 6/2007 | Gardos | 222/1 |
| 7,337,920 | B2 * | 3/2008 | Duck et al. | 222/63 |
| 7,635,253 | B2 * | 12/2009 | Garcia-Ortiz | 417/44.2 |
| 2005/0142005 | A1 | 6/2005 | Traylor | |

FOREIGN PATENT DOCUMENTS

| | | | |
|---|---|---|---|
| DE | 3210239 | C2 | 2/1988 |
| DE | 202006011928 | U1 | 10/2007 |
| EP | 1515044 | A1 * | 3/2005 |
| EP | 1520986 | B1 | 5/2005 |
| EP | 1520988 | B1 | 1/2006 |
| GB | 2161221 | A | 1/1986 |

* cited by examiner

POSITIVE DISPLACEMENT PUMP WITH A WORKING FLUID AND LINEAR MOTOR CONTROL

FIELD

This invention relates generally to fluid pumps. More particularly, this invention relates to positive displacement hydraulic diaphragm pumps driven by a linear motor.

BACKGROUND

Positive displacement hydraulic diaphragm type pumps are known in the art for delivery of pumped media, typically fluids, by a pumping action between inlet and outlet valves. Hydraulic diaphragm type pumps make use of a deformable diaphragm fluidly connected to a pumping chamber between the inlet and outlet valves between which the pumped media is moved by constrictive pressure exerted by the diaphragm. The diaphragm is in turn forced to move by a powered mechanical displacement mechanism whose displacement is transmitted to the diaphragm via a working fluid. One particular type of diaphragm is the hose diaphragm.

The deformable hose diaphragm is typically a generally cylindrical membrane, or bladder, with 2 openings, one at substantially each end of the diaphragm, to separate the pumped media in a pumping chamber located inside of the diaphragm from a working fluid surrounding the diaphragm. The hose diaphragm is typically constructed from substantially impervious materials permissive of deformation to change the internal volume of the diaphragm, such as pliable and/or elastic materials like polymeric, plastic, metallic foil, rubber materials, in solid or laminated form, for example. Preferably the pumped media flows from one end through to the other end of the hose diaphragm. Due to the substantially straight flow of the pumped media through the hose diaphragm, and the separation between the pumped media and the working fluid and mechanical components of the pump, this type of positive displacement pump is typically suited for pumping highly viscous materials, abrasive, reactive or corrosive materials, slurries and sludges, as well as less viscous fluids at a wide range of pressures. Although hose diaphragm pumps are discussed in particular below, the field of the present invention applies to all forms of hydraulic diaphragm pumps. In the case of hydraulic diaphragm pumps using an alternate diaphragm other than a hose diaphragm, the description below may be interpreted such that the two working surfaces of the alternate diaphragm correspond to the inside and outside of a hose diaphragm.

Hose diaphragm pumps according to the art may typically provide a constrictive pressure around the hose diaphragm to provide the necessary pumping action of the pumped media inside the diaphragm by displacing a working fluid surrounding the hose diaphragm with a reciprocating piston to constrict (effectively decreasing the internal volume of the hose diaphragm and the pumped media within) and expand (effectively increasing the internal volume of the hose diaphragm and the pumped media within) the hose diaphragm respectively. In the hose diaphragm pumps according to the art, the movement of the reciprocating piston is typically provided by the use of a connecting rod to convert the rotating motion of a drive crank to a reciprocating linear motion to drive the piston. This drive mechanism results in a varying piston velocity over the stroke of the piston due to the arrangement of the crank and connecting rod, wherein the peak velocity of the piston is typically greater than the mean velocity of the piston by a factor of at least 1.6. Although the use of cams have been disclosed in the art to reduce this peak/mean piston velocity factor to some extent, the crank and connecting rod drive mechanism of the hose diaphragm pumps according to the art typically result in a substantial period of acceleration and deceleration of the piston at the ends of the piston stroke, and lag while changing direction. Further, in order to cause a given linear displacement of the piston, it is required to impart a varying degree of rotation of the drive crank, depending upon the location of the piston relative to its stroke limits, thus limiting the precision and accuracy of piston displacement control in the hydraulic diaphragm pumps according to the prior art.

As a result of the characteristics of the crank and connecting rod drive mechanism typically employed in the hydraulic diaphragm pumps according to the art, the pumping characteristics of such conventional diaphragm pumps have several limitations. One limitation is that there is a substantial flow variation during the constriction or expansion phase of the pumping chamber, such that pumped media flows from a pump with even three or more pumping chambers operating in staggered phase are uneven or peaky, typically requiring surge control reservoirs and the like to desirably reduce the peakiness of the pumped media output flow. Another limitation is that the flow variation results in the acceleration and deceleration of both the suction and discharge fluid volumes resulting in dissipation of work to frictional losses. A further limitation is that the peak pressure of the pumped media output flow and the corresponding minimum suction pressure (or peak suction) of the pumped media inlet flow into the pump are significantly higher and lower than the mean pressure and corresponding mean suction, respectively. The minimum suction pressure of the pumped media inlet flow is typically a limiting factor in a diaphragm type pumps due to the requirement to maintain a net positive suction head pressure in the pumped media inlet flow to avoid boiling or cavitation of the pumping media. Yet a further limitation is that in order to produce a given volume of pumped media output flow, the required crank drive input varies depending upon the position of the working fluid piston relative to its stroke.

It is an object of the present invention to provide a positive displacement hydraulic diaphragm pump that addresses some of the limitations of the hydraulic diaphragm pump designs, and particularly hose diaphragm pump designs according to the art.

SUMMARY OF THE INVENTION

According to one embodiment of the present invention, a positive displacement pump is provided, comprising:

first and second pumped media pumping chambers, comprising first and second deformable hose diaphragms, wherein each said pumping chamber is fluidly connected to an inlet end and an outlet end;

inlet and outlet flow control valves in fluid connection with the inlet and outlet ends of each of the pumping chambers;

a working fluid drive cylinder assembly having first and second ends containing a working fluid;

a working fluid drive piston slidably situated within the working fluid drive cylinder between the first and second ends;

at least one linear motor attached to the working fluid drive piston such that a linear reciprocating motion of the linear motor drives a reciprocating motion of the working fluid drive piston within the working fluid drive cylinder assembly; and first and second working fluid compression jackets enclosing at least a portion of the first and second pumping chambers wherein the first and second working fluid compression jackets contain a working fluid in fluid communication with the first and second ends respectively of the working fluid drive cylinder assembly such that a reciprocating movement of the working fluid drive piston driven by the linear motor alternatingly applies a constrictive and expansive force to each of the first and second deformable hose diaphragms in opposite phase to each other.

According to another embodiment of the present invention, a method of operating a positive displacement pump comprising at least one pumping chamber comprising a deformable hose diaphragm wherein each pumping chamber comprises an inlet end and an outlet end, a working fluid displacement assembly, a linear motor attached to the working fluid displacement assembly such that a linear reciprocating movement of the linear motor drives displacement of the working fluid within at least one working fluid compression jacket enclosing at least a portion of each pumping chamber, such that displacement of the working fluid driven by the reciprocating movement of the linear motor alternatingly applies a constrictive and expansive force to each of the deformable hose diaphragms is provided. The method comprises controlling the linear motor to generate a linear reciprocating motion characterized by a substantially constant velocity over a range of linear motion between first and second positions.

According to a further embodiment of the present invention, a method of operating a positive displacement pump comprising at least one pumping chamber comprising a deformable hose diaphragm wherein each pumping chamber is fluidly connected to an inlet end and an outlet end, a working fluid displacement assembly, a linear motor attached to the working fluid displacement assembly such that a linear reciprocating motion of the linear motor drives displacement of the working fluid within at least one working fluid compression jacket enclosing at least a portion of each pumping chamber, such that displacement of the working fluid driven by the reciprocating movement of the linear motor alternatingly applies a constrictive and expansive force to each of deformable hose diaphragms is provided, the method comprising controlling the linear motor to generate a substantially constant pumping media flow through the positive displacement pump.

DETAILED DESCRIPTION OF SEVERAL EMBODIMENTS

Exemplary embodiments of the present invention are illustrated in referenced figures of the drawings. It is intended that the embodiments and figures disclosed herein are to be considered illustrative rather than restrictive.

Figure 1:
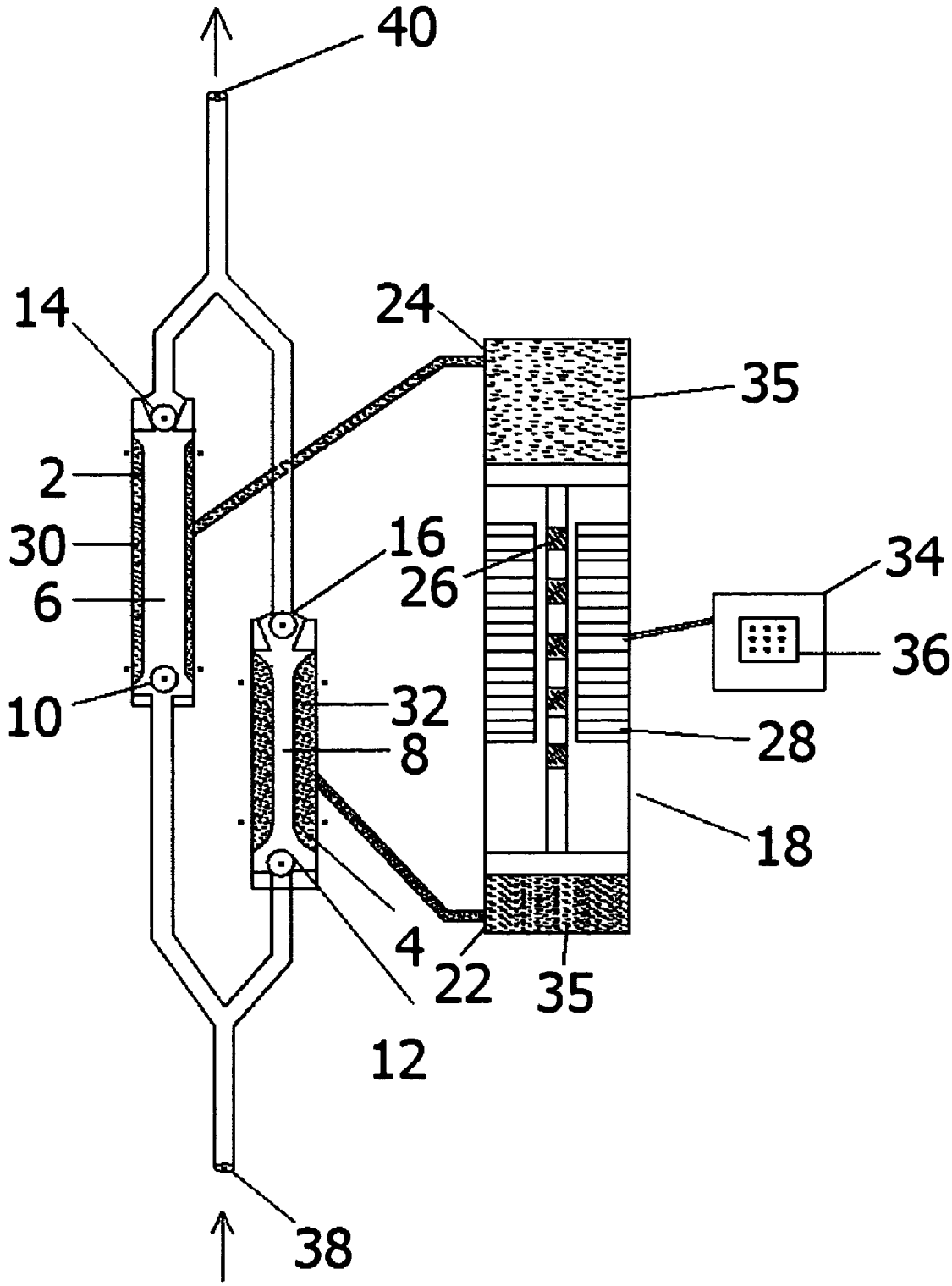
FIG. 1 is a partial cross-sectional view of a positive displacement pump driven by a linear motor integrated into a drive cylinder assembly, according to an embodiment of the present invention.

FIG. 1 illustrates a simplified positive displacement hose diaphragm pump according to an embodiment of the present invention. The hose diaphragm pump includes hose diaphragms 2 and 4, separating pumped media pumping chambers 6 and 8 respectively, from working fluid compression jackets 30 and 32. The working fluid compression jackets 30 and 32 are operable to alternately compress (effectively decreasing the internal volume of the pumping chamber and the pumped media within) and expand (effectively increasing the internal volume of the pumping chamber and the pumped media within) hose diaphragms 2 and 4 in response to displacement of a working fluid into or out of the compression jackets, respectively. Working fluid compression jackets 30 and 32 may typically comprise inlet and outlet ends and a generally cylindrical shell to contain the working fluid and hose diaphragm, although other shapes and configurations may be used. The hose diaphragm may typically seal against the shell or ends of the working fluid compression jacket to contain the working fluid between the shell and the hose diaphragm to facilitate compression and expansion of the pumping chamber.

Inlet end flow control valves 10 and 12 and outlet end flow control valves 14 and 16 control flow of pumped media into and out of pumping chambers 6 and 8 respectively, and may comprise any suitable type of flow control valve, typically a one-way passively operated valve, such as ball, cone, or poppet check valves, for example. Alternatively, actively operated valves may also be used. Common pumped media flow inlet 38 is fluidly connected to inlet end flow control valves 10 and 12, and common pumped media flow outlet 40 is fluidly connected to outlet end flow control valves 14 and 16.

Working fluid drive cylinder 18 includes first end 24 fluidly connected to working fluid compression jacket 30 surrounding hose diaphragm 2, and second end 22 fluidly connected to working fluid compression jacket 32 surrounding hose diaphragm 4. Working fluid drive cylinder assembly 18 contains working fluid 35 surrounding working fluid piston 26 which is slidably situated within the working fluid drive cylinder 18. Working fluid 35 may typically be a hydraulic oil although other substantially incompressible fluids can be chosen. Linear motor 28 is attached to working fluid piston 26 such that linear motor 28 can drive a reciprocating linear motion of working fluid piston 26 within working fluid cylinder 18. The reciprocating linear motion of the working fluid piston 26 driven by linear motor 28, is effective to alternatingly displace working fluid 35 in and out of working fluid compression jackets 30 and 32, and thereby to apply alternating constrictive and expansive forces on hose diaphragms 2 and 4 in opposite phase to each other, resulting in the alternate pumping of the pumped media through pumping chambers 6 and 8. The pumping chambers 6 and 8 change their internal volume by substantially the same volume change that is made in first end 24 and second end 22, respectively, of the working fluid piston inside working fluid drive cylinder 18.

Figure 1A:
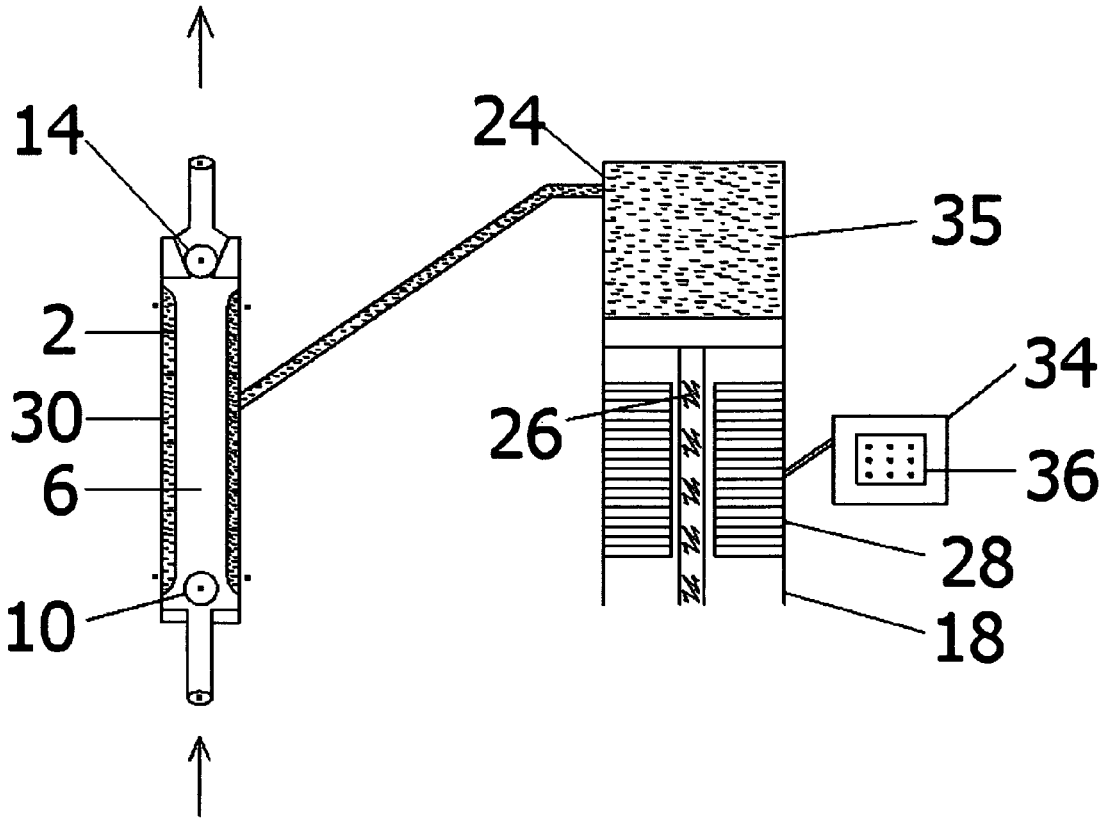
FIG. 1A is a partial cross-sectional view of a positive displacement pump comprising a single pumping chamber driven by a linear motor integrated into a drive cylinder assembly, according to an embodiment of the invention.

FIG. 1A illustrates a positive displacement pump comprising a single pumping chamber driven by a linear motor integrated into a drive cylinder assembly, according to an alternative embodiment of the invention. The single pumping chamber embodiment of FIG. 1A is substantially similar to the pump embodiment of FIG. 1, except that a single pumping chamber 6 is provided rather than the dual pumping chambers 6 and 8 of the embodiment illustrated in FIG. 1. Similar to as described above in reference to FIG. 1, the single pumping chamber 6 of FIG. 1A comprises a hose diaphragm 2 surrounded by working fluid compression jacket 30, which is operable to alternately compress and expand hose diaphragm 2 in response to the displacement of a working fluid into or out of the compression jacket 30. The flow of pumped media into and out of pumping chamber 6 is controlled by inlet and outlet end flow control valves 10 and 14 respectively, similar to as described above in reference to FIG. 1.

Also similar to as illustrated in FIG. 1, working fluid drive cylinder assembly 18 of the pump embodiment of FIG. 1A includes working fluid 35 connected at first end 24 to working fluid compression jacket 30 surrounding hose diaphragm 2. Working fluid piston 26 is slidably situated within working fluid drive cylinder 18, and is attached to linear motor 28 such that linear motor 28 can drive a reciprocating linear motion of working fluid piston 26, and thereby to alternatingly displace working fluid 35 in and out of working fluid compression jacket 30. Similar to as described above in reference to FIG. 1, such alternating displacement of working fluid 35 into and out of compression jacket 30 may thereby apply alternating constrictive and expansive forces on hose diaphragm 2, resulting in the pumping of the pumped media through pumping chamber 6.

In an alternative embodiment, more than 2 hose diaphragms may be used collectively to pump a pumped media in response to displacements of a working fluid surrounding the hose diaphragms, such as 3, 4, 6, or 8 hose diaphragms for example. In another alternative embodiment, a single pumping chamber with one or more hose diaphragms may be used to pump a pumped media, such as in applications not requiring continuous flow of the pumped media, for example.

In one embodiment, linear motor 28 may typically be an electromagnetic linear motor which may be electrically controllable. Suitable such linear motors may comprise induction or synchronous type linear motors operable to provide desirably precise electrically controlled linear movement, such as desirably precise control of linear position, velocity and acceleration, to drive a working fluid piston such as piston 26. More particularly, suitable linear motors may comprise high force brushless AC or DC linear motors, which may comprise permanent (such as neodymium) magnets or electromagnets, and iron or air core moving coil assemblies, such as are available from H2W Technologies Inc. of Valencia, Calif., for example. The linear motor 28 may be directly connected to the working fluid piston 26 as shown in FIG. 1, or may alternatively be indirectly connected to the working fluid piston such as through a gear train, mechanical linkage, or other transmission means which is operable to convert the reciprocating linear driving motion of the linear motor to a linear reciprocating motion of the working fluid piston. In any of the exemplary embodiments described herein, multiple linear motors may be used collectively, in the place of a single linear motor, to drive one or more working fluid piston assemblies comprising one or more working fluid pistons. For example, in embodiments adapted for delivering pumped media at high pressures and/or high flow rates, multiple linear motors may be adapted to drive a working fluid piston assembly, and the multiple linear motors may be independently or collectively controlled to govern the linear driving motion imparted to the working fluid piston(s).

In another embodiment, the linear motor 28 in the inventive positive displacement hose diaphragm pump includes a control module 34 to electrically control the linear driving motion of linear motor 28. The control module 34 typically includes a control program 36, which may be stored on a computer readable medium such as a logic chip, RAM (randomly accessible memory) or ROM (read only memory) chip, magnetic, optical or magneto-optical computer readable medium, for example. Control program 36 may comprise computer readable instructions to effect control of the linear driving motion of linear motor 34.

In an exemplary embodiment directed to providing a substantially constant flow of pumped media through the inventive positive displacement pump, the control program 36 may desirably comprise instructions to control the linear motor 34 to produce a linear driving motion of substantially constant velocity. Such substantially constant velocity linear driving motion may desirably effect a substantially constant velocity of the working fluid piston 26, and thereby of the alternating contraction and expansion of the volumes of the pumping chambers 6 and 8 and pumping of the pumped media within.

In another exemplary embodiment directed to providing a substantially constant pumped media inlet pressure at the inlet 38 of the inventive pump, the control program 36 may desirably comprise instructions to control the linear motor 34 to produce a varying driving motion of working fluid piston 26 and therefore varying rate of volumetric expansion of the pumping chambers 6 and 8 that corresponds to maintaining a desired pumped media inlet pressure. In particular, it may be desired to control the linear motor 34 to provide a pumped media inlet pressure that is greater than or equal to a net positive suction head pressure for a selected pumped media, to avoid cavitation or boiling of the pumped media at the inlet of the pump 38.

In yet another exemplary embodiment directed to providing a varying flow rate of pumped media through the inventive positive displacement pump, the control program 36 may desirably comprise instructions to control the linear motor 34 to produce a linear driving motion that varies according to a desired linear motion velocity profile. In particular, for use with pumped media that may demonstrate varying rheological properties at different rates of strain, it may be desirable to control the linear motor to produce a linear driving motion with a linear motion velocity profile derived from or based on a rheological profile of the pumped media.

In an exemplary embodiment directed to providing a metered or dosed flow of pumped media through the inventive positive displacement pump, the control program 36 may desirably comprise instructions to control the linear motor 34 to produce a linear driving motion of a desired length in response to a control signal. The desired length of the linear driving motion of the linear motor 34 may desirably correspond to a desired metered or dosed volume of pumped media desired to be pumped by the inventive pump. Alternatively, for applications requiring a precisely metered flowrate (volume/time) of a pumped medium, an exemplary embodiment of the present invention is provided wherein control program 36 may desirably comprise instructions to control the linear motor 34 to produce a linear driving motion of a desired velocity in response to a control signal. The desired velocity of the linear driving motion of the linear motor 34 may desirably correspond to a desired metered flowrate of pumped media desired to be pumped. In some embodiments, the desired metered flowrate of pumped media may vary over time, in which case, the linear motor 34 may be controlled to produce a desirably varying linear driving motion profile to correspond to the desired variable metered flowrate profile for the pumped media. Such embodiments may be particularly suited to applications requiring precise controllable dosing or flow metering of a pumped media, such as in chemical process or treatment applications where the pumped media may comprise a chemical reagent for example.

Figure 2:
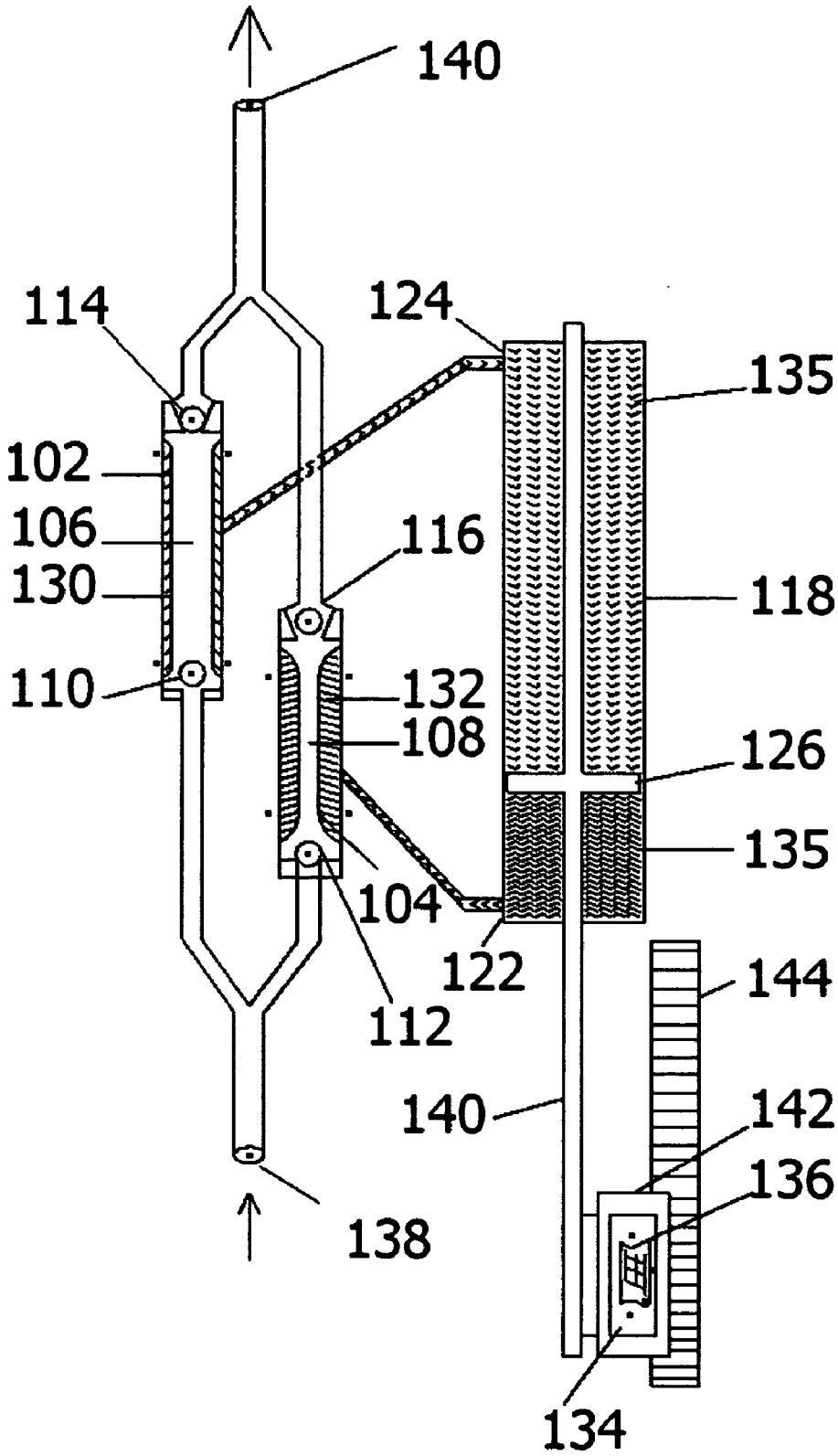
FIG. 2 is a partial cross-sectional view of a positive displacement pump driven by a linear motor external to a drive cylinder assembly, according to an embodiment of the present invention.

FIG. 2 illustrates a positive displacement hose diaphragm pump according to a further embodiment of the present invention, wherein a linear motor is located external to a drive cylinder assembly. Similar to as described above in reference to FIG. 1, the inventive pump of FIG. 2 includes hose diaphragms 102 and 104, defining pumped media pumping chambers 106 and 108 respectively, and surrounded by working fluid compression jackets 130 and 132 to alternately compress (effectively decreasing the internal volume of the pumping chamber and the pumped media within) and expand (effectively increasing the internal volume of the pumping chamber and the pumped media within) hose diaphragms 102 and 104 in response to displacement of a working fluid into or out of the compression jackets, respectively. Also similar to the pump described in FIG. 1, inlet end flow control valves 110 and 112 and outlet end flow control valves 114 and 116 control flow of pumped media into and out of pumping chambers 106 and 108 respectively, and common pumped media flow inlet 138 and common pumped media flow outlet 140 are fluidly connected to valves 110 and 112 and valves 114 and 116, respectively. Working fluid drive cylinder 118 is connected to compression jackets 130 and 132 by first and second ends 124 and 122, respectively. Working fluid drive cylinder assembly 118 contains working fluid 135 surrounding working fluid piston 126 which is slidably situated within the working fluid drive cylinder 118.

In the inventive pump embodiment shown in FIG. 2, a reciprocating linear motion of working fluid piston 126 within working fluid cylinder assembly 118 is driven by a linear motor located external to cylinder assembly 118, comprising linear motor rotor 142 and linear motor stator 144. The linear motor stator 144 may be desirably fixed to cylinder assembly 118, or other suitable stationary support to provide a reference and reaction point for linear movement of linear motor rotor 142 along the stator 144. The linear motor rotor 142 is desirably connected to working fluid piston 126 through piston shaft 140 which is located external to cylinder assembly 118. Such connection may be direct as shown in FIG. 2, or may alternatively be indirect, such as through a transmission, mechanical linkage, or gearing, so as to transfer the linear motion of rotor 142 to reciprocating linear movement of piston 126 to drive expansion and contraction of pumping chambers 106 and 108, and thereby pumping of the pumped media.

In an alternative embodiment, a positive displacement pump may be provided using non-piston working fluid displacement assemblies. For example, a positive displacement pump according to the present invention may comprise a plunger or diaphragm type working fluid displacement mechanism utilizing stationary seals to displace working fluid in response to a driving force from a linear motor, in place of the reciprocating working fluid displacement piston (s) moving inside a working fluid cylinder shown in FIGS. 1 and 2. Such alternative embodiments comprising a stationary sealed working fluid plunger or diaphragm may be desirably adapted for use in applications requiring high pumped media pressures, for example.

Similar to as described above in reference to FIG. 1, the linear motor of FIG. 2 may comprise any suitable type of desirably electrically controllable electromagnetic linear motor, such as those recited above, for example. In one embodiment, the linear motor stator 144 may comprise multiple permanent or electro-magnets, and the linear motor rotor 142 may comprise multiple coil windings. In another embodiment, the linear motor comprising rotor 142 and stator 144 in the inventive positive displacement hose diaphragm pump shown in FIG. 2 may also include a control module 134 to electrically control the linear driving motion of rotor 142. The control module 134 typically includes a control program 136, which may be stored on a computer readable medium such as a logic chip, RAM (randomly accessible memory) or ROM (read only memory) chip, magnetic, optical or magneto-optical computer readable medium, for example. Control program 136 may comprise computer readable instructions to effect control of the linear driving motion of linear motor 134 in a desired manner, as is described above in various embodiments.

In an alternative embodiment, individual working fluid drive cylinder assemblies and working fluid pistons may be provided for each compression jacket and enclosed hose diaphragm in the inventive pump. Such individual working fluid pistons may be collectively connected to a single linear motor for collective driving of the pistons, or may alternatively be individually connected to individual linear motors for independently controllable driving of the pistons, and therefore the compression jackets and enclosed hose diaphragms and pumping chambers.

Figure 2A:
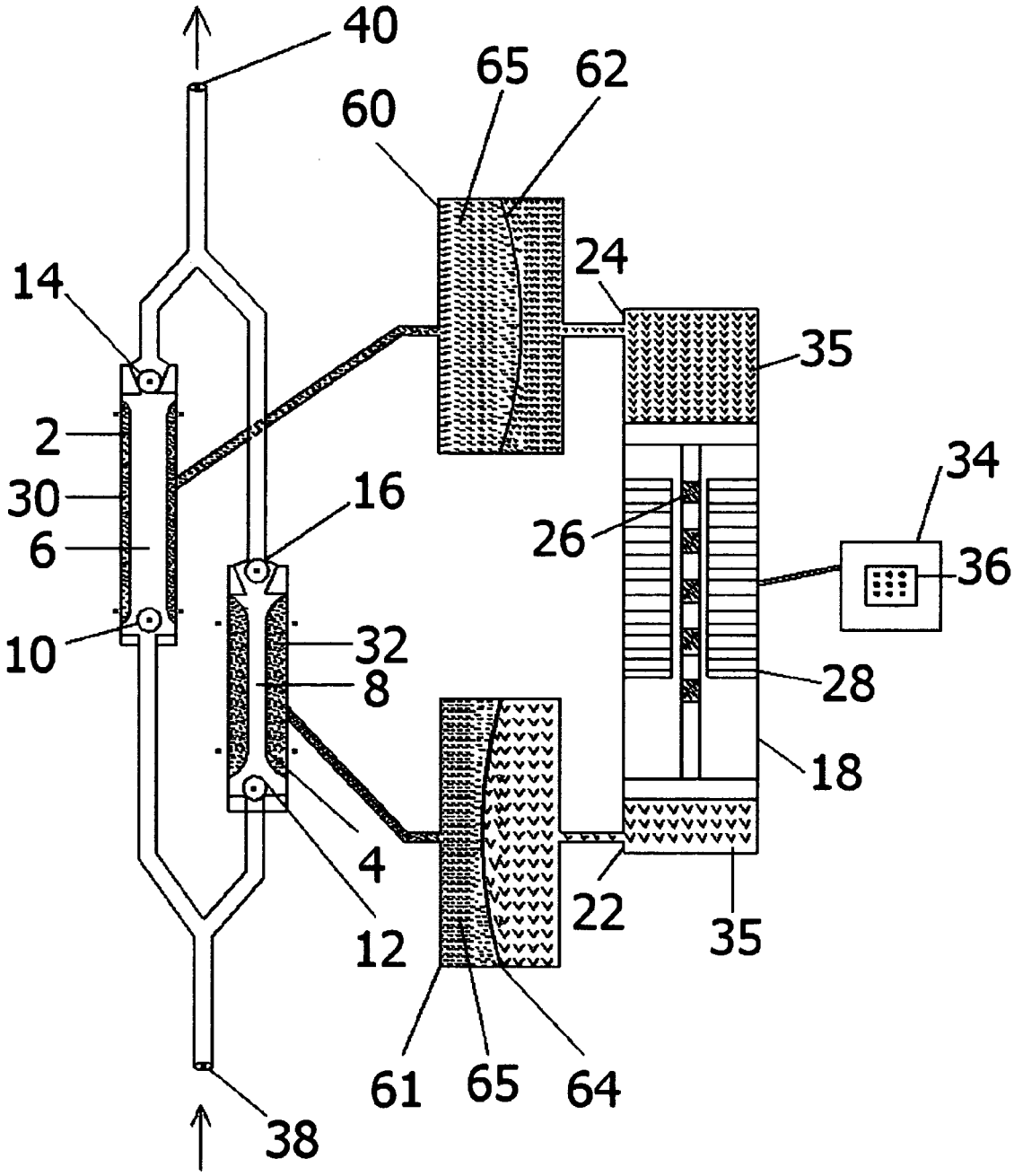
FIG. 2A is a partial cross-sectional view of a portion of a positive displacement pump comprising secondary hydraulic diaphragms driven by a linear motor, according to an embodiment of the present invention.

FIG. 2A illustrates a positive displacement pump comprising secondary hydraulic diaphragms 62 and 64, and driven by a linear motor 28, according to an embodiment of the present invention. The positive displacement pump embodiment illustrated in FIG. 2A is substantially similar to the embodiment of FIG. 1 as described above, except that the FIG. 2A embodiment additionally comprises secondary hydraulic diaphragms 62 and 64 to separate a first working fluid 65 in fluid contact with the hose diaphragms 2 and 4, from a second working fluid 35 contained in the working fluid drive cylinder 18. Secondary hydraulic diaphragm 62 is retained in a hydraulic diaphragm assembly 60, to separate the first working fluid 65 which is in fluid contact with and surrounding hose diaphragm 2, from second working fluid 35 contained in drive cylinder assembly 18. Similarly, secondary hydraulic diaphragm 64 is retained in hydraulic diaphragm assembly 61 to separate the first working fluid 65 which is in fluid contact with and surrounding hose diaphragm 4, from second working fluid 35. Accordingly, the first and second working fluids 65 and 35 may be separated, but remain in fluid communication with each other, such that displacement of the second working fluid 35 by piston 26 in working fluid drive cylinder 18 results in a displacement of the first working fluid 65, to contract or expand the hose diaphragms 2 and 4. The positive displacement pump embodiment of FIG. 2A comprising secondary hydraulic diaphragms 62 and 64 may therefore desirably prevent contamination of second working fluid 35 by a pumped media in pump chambers 6 and 8 should either of hose diaphragms 2 and 4 fail, for example.

In another alternative embodiment, a first working fluid in fluid contact with the hose diaphragms of the inventive pump may be desirably distinct from a second working fluid contained in the drive cylinder assembly, such as to avoid contamination of the pumped media with the second working fluid or contamination by the pumped media of the second working fluid should a hose diaphragm fail, for example. In particular, in such an embodiment a secondary diaphragm may be used to separate the first working fluid from the second working fluid, but maintain fluid communication between the two working fluids, such that displacement of the second working fluid by a piston in the drive cylinder assembly results in a displacement of the first working fluid in the compression jacket, to contract or expand the hose diaphragm.

Figure 3:
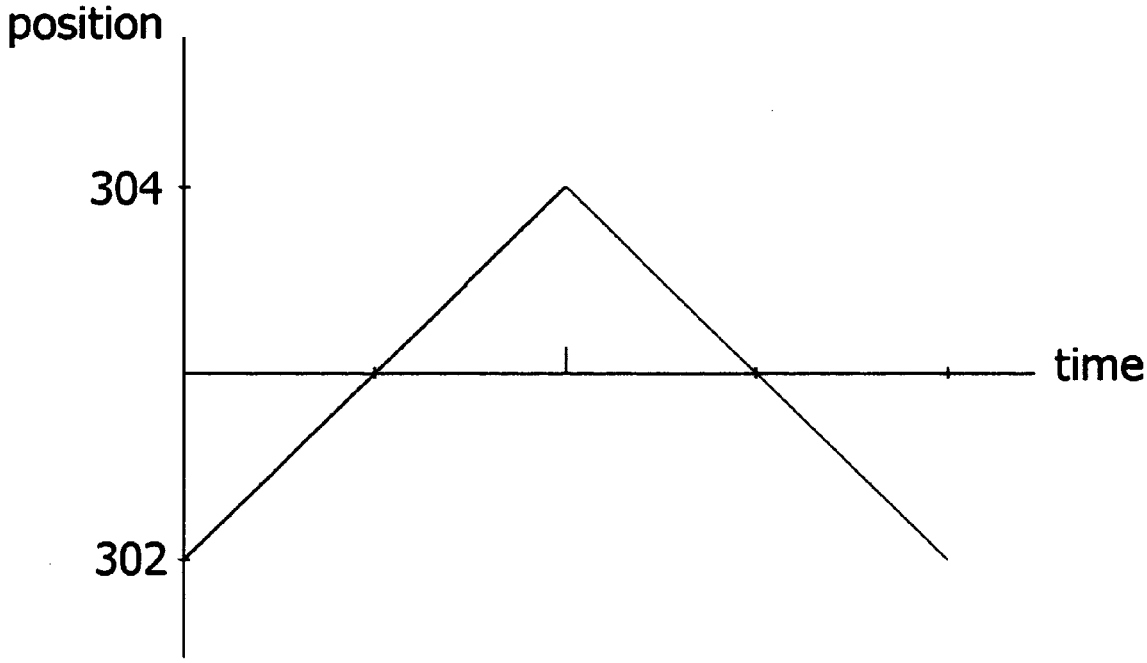
FIG. 3 is a linear motion position profile for a linear motor driven positive displacement pump, according to an embodiment of the present invention.

FIG. 3 shows a linear motion position profile for a linear motor driven positive displacement pump according to an embodiment of the present invention. In an exemplary embodiment directed to providing a substantially constant flow of pumped media through the inventive pump, a linear motor may be desirably controlled to generate a linear reciprocating motion of the linear motor characterized by the linear position profile of FIG. 3 over a range of linear motion between first position 302 and second position 304. As can be seen in the profile of FIG. 3, the velocity of the motion of the linear motor in such an embodiment is substantially constant (substantially constant slope of profile) between positions 302 and 304.

Figure 4:
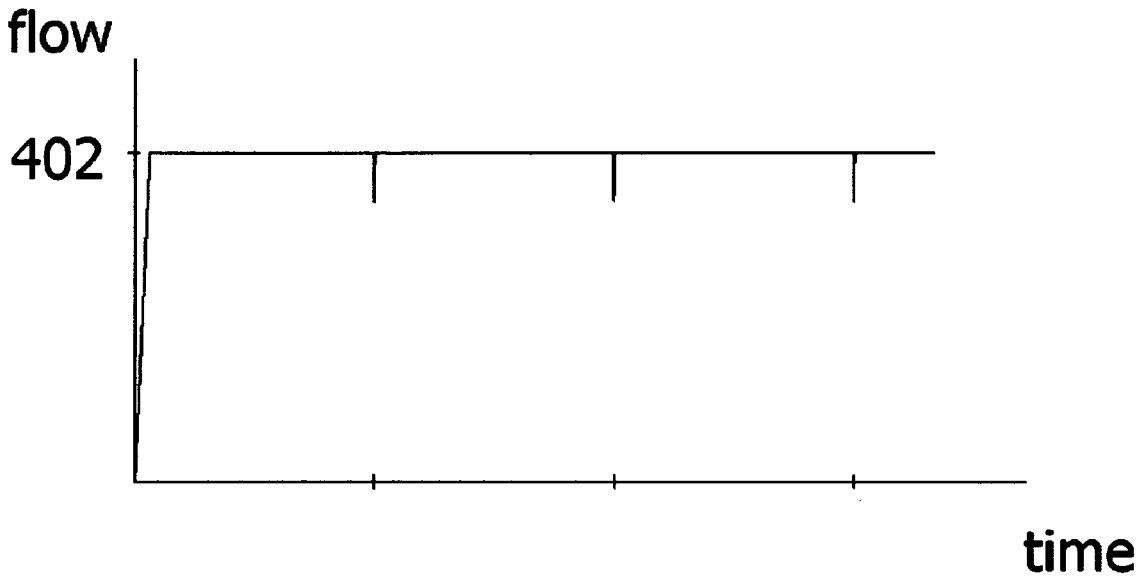
FIG. 4 is a pumped media flow profile for a linear motor driven positive displacement pump, according to an embodiment of the present invention.

FIG. 4 shows a pumped media flow profile for a linear motor driven positive displacement pump according to an embodiment of the present invention. The pumped media flow profile shows a substantially constant flow rate 402 of the pumped media corresponding to operation of the linear motor of an inventive pump with two hose diaphragms in accordance with a linear position profile such as shown in FIG. 3. The substantially constant flow rate 402 may be desirably realized by operating the linear motor to effect a linear driving motion with a substantially constant velocity, punctuated by very rapid (preferably substantially instantaneous) changes of direction of the linear motor at the end of its stroke between first and second positions 302 and 304.

Figure 5:
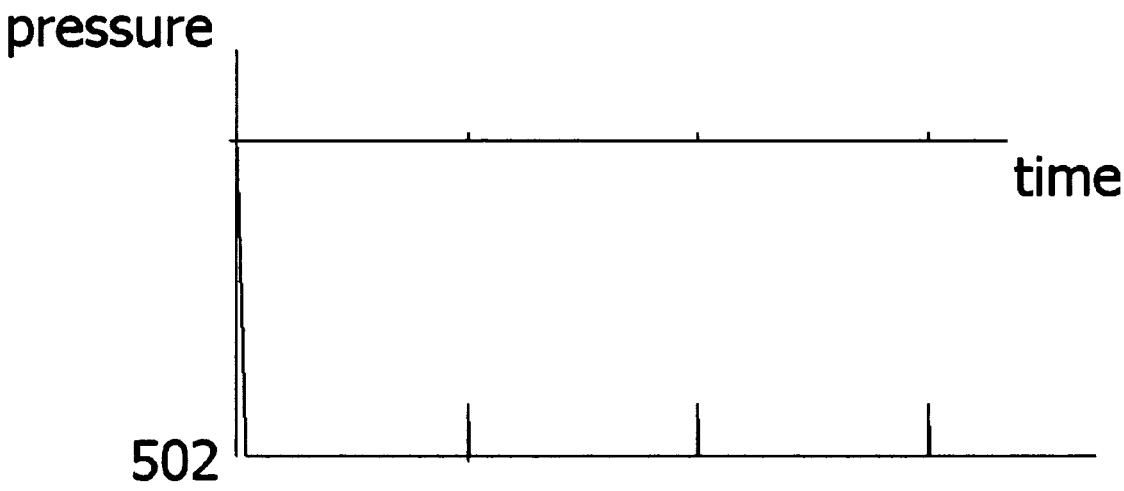
FIG. 5 is a pumped media inlet pressure profile for a linear motor driven positive displacement pump, according to an embodiment of the present invention.

FIG. 5 shows a pumped media inlet pressure profile for a linear motor driven positive displacement pump according to an embodiment of the present invention. The pumped media inlet pressure profile shows a substantially constant minimum inlet pressure 502 at the inlet of the pump, corresponding to operation of the linear motor of a pump with two hose diaphragms in accordance with a linear position profile such as shown in FIG. 3. The substantially constant minimum inlet pressure 502 may be desirably realized by operating the linear motor to effect a linear driving motion with a substantially constant velocity, punctuated by very rapid (preferably substantially instantaneous) changes of direction of the linear motor at the end of its stroke between first and second positions 302 and 304.

Figure 6:
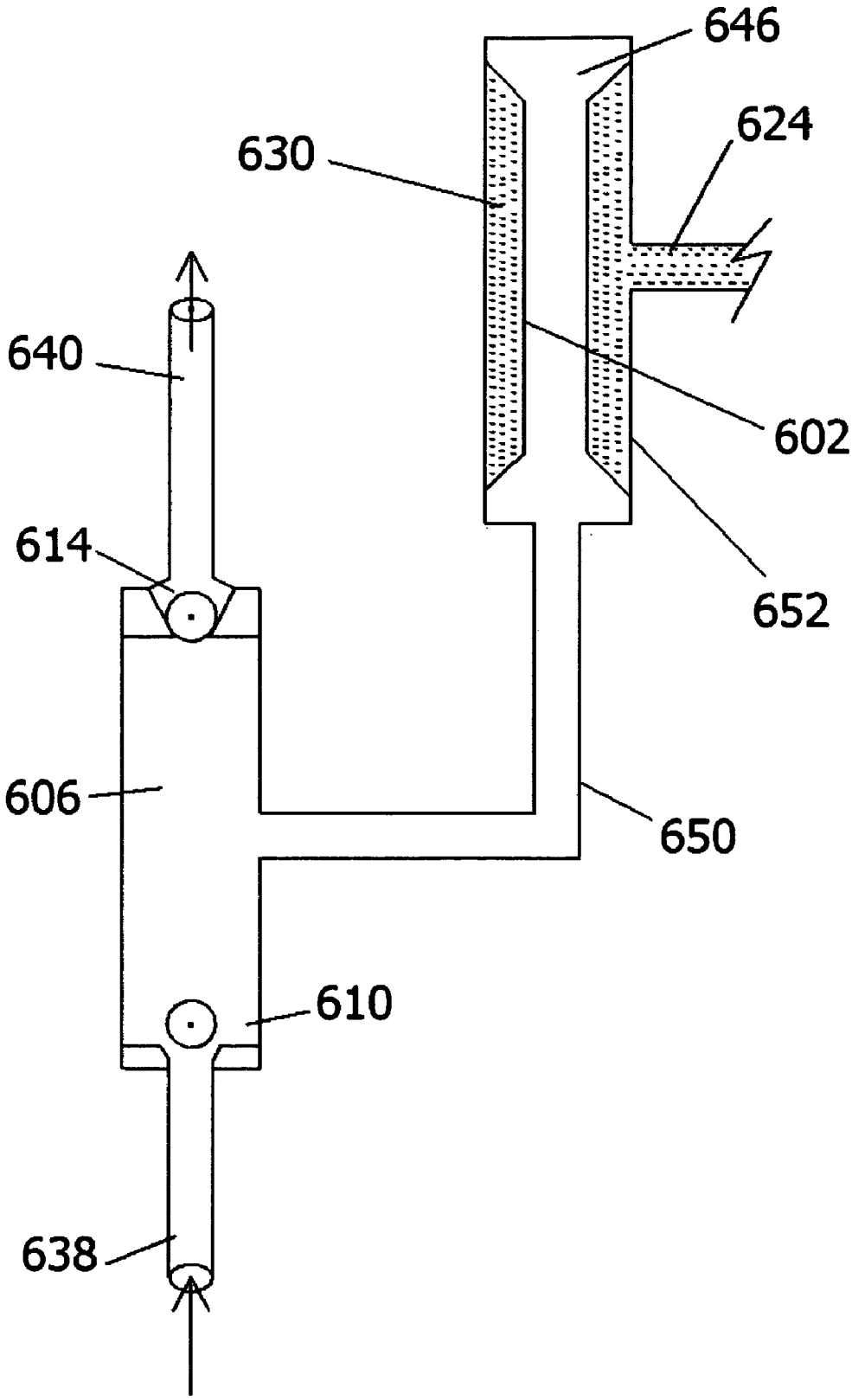
FIG. 6 is a partial cross-sectional view of a portion of a positive displacement pump comprising a multi-part pumping chamber, according to an embodiment of the present invention.

FIG. 6 shows a portion of a positive displacement hose diaphragm pump assembly according to a further embodiment of the present invention, comprising a multi-part pumped media pumping chamber 606. The pump assembly comprises pumped media inlet 638 and outlet 640, and inlet end 610 and outlet end 614 flow control valves, similar to the embodiments shown in FIGS. 1 and 2. The pumped media pumping chamber 606 of the assembly of FIG. 6 additionally comprises pumped media transfer conduit 650, and variable volume pumped media pumping chamber 646 within working fluid compression jacket 652 and hose diaphragm 602. Similar to the function of the pumped media pumping chambers shown in FIGS. 1 and 2, the volume of variable volume pumped media pumping chamber 646 may be increased and decreased by the displacement of working fluid 630 supplied by working fluid conduit 624 around hose diaphragm 602. Working fluid 630 may be displaced in and out of compression jacket 652 through conduit 624 by any suitable means described above, such as by a working fluid piston driven by one or more linear motors, for example. A positive displacement hose diaphragm pump utilizing the multi-part pumped media pumping chamber assembly shown in FIG. 6 may be particularly suited for applications where it is desirable to at least partially isolate the hose diaphragm 602 from the pumped media entering pumped media chamber 606 through inlet 638, such as in high temperature applications, for example.

Figure 7:
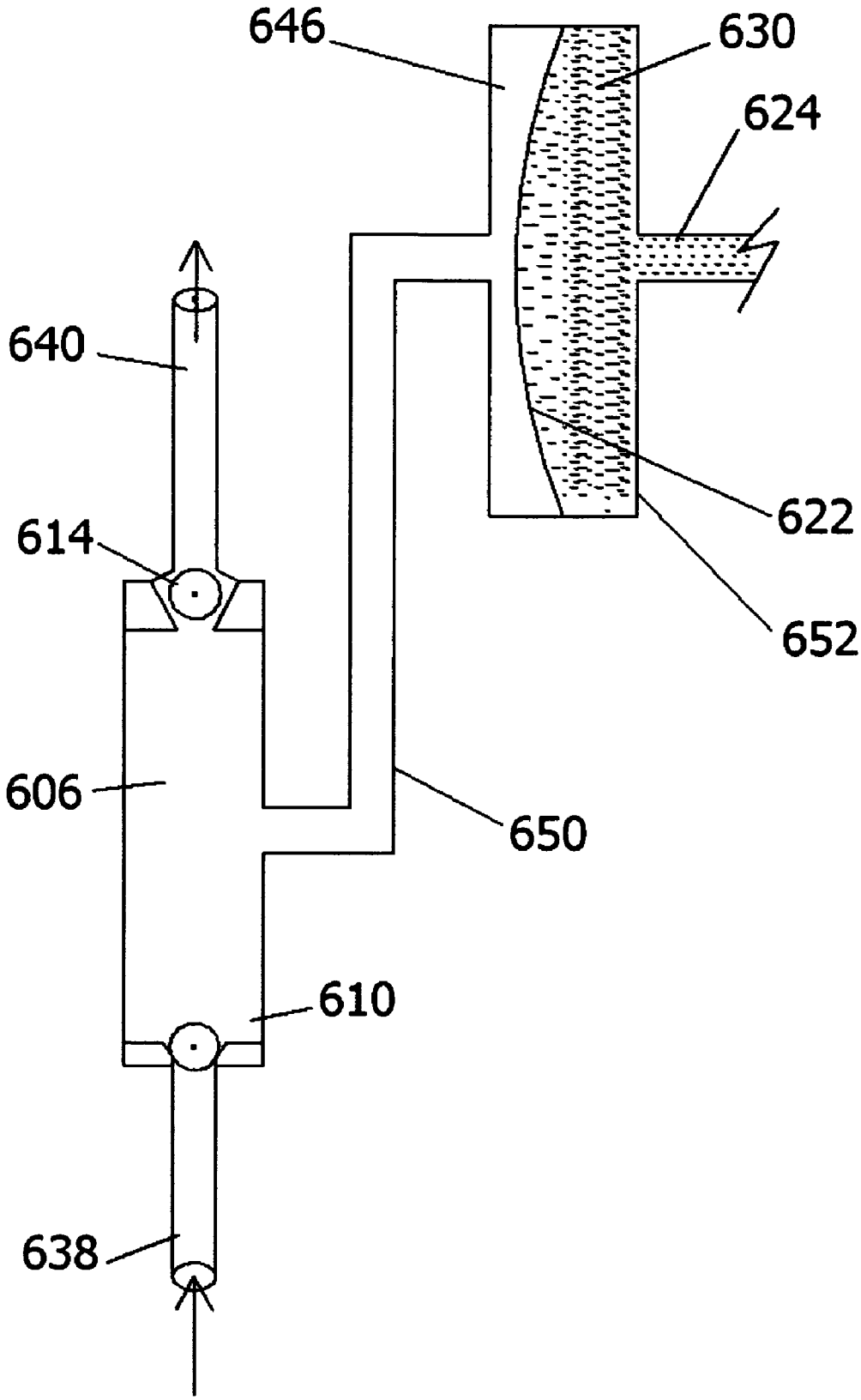
FIG. 7 is a partial cross-sectional view of a portion of a positive displacement pump comprising a multi-part pumping chamber with a hydraulic diaphragm, according to an embodiment of the present invention.

FIG. 7 illustrates a portion of a positive displacement pump comprising a multi-part pumped media pumping chamber 606 with a hydraulic diaphragm 622, according to another embodiment of the present invention. The multi-part media pumping chamber 606 of FIG. 7 is substantially similar to the embodiment shown in FIG. 6 and described above, except that a hydraulic diaphragm 622 is used in place of the hose diaphragm 602 of the embodiment of FIG. 6. Accordingly, in the multi-part pumping chamber embodiment illustrated in FIG. 7, the pump assembly comprises pumped media inlet 638 and outlet 640 with corresponding inlet and outlet end flow control valves 610 and 614 respectively. The pumped media pumping chamber 606 of the assembly of FIG. 7 comprises pumped media transfer conduit 650, and variable volume pumped media pumping chamber 646 separated from working fluid compression jacket 652 by hydraulic diaphragm 622. Similar to the embodiments of FIGS. 1, 2, and 6, the volume of variable volume pumped media pumping chamber 646 may be increased and decreased by the displacement of working fluid 630 supplied by working fluid conduit 624 against hydraulic diaphragm 622. Working fluid 630 may be displaced in and out of compression jacket 652 through conduit 624 by any suitable means, such as those described above including a working fluid piston (not shown) driven by one or more linear motors (not shown) for example. Similar to the embodiment illustrated in FIG. 6, the a positive displacement pump utilizing the multi-part pumped media pumping chamber assembly illustrated in FIG. 7 may also be suited for application where it is desirable to at least partially isolate the hydraulic diaphragm 622 from the pumped media entering pumped media chamber 606 through inlet 638.

In another general embodiment according to the present invention, the use, control and/or programming of a linear motor to drive a pumped media pumping chamber in a positive displacement pump as described above may be applied to any type of hydraulic diaphragm pump. Thus, hydraulic diaphragm pumps having diaphragm means other than hose diaphragms may be driven by one or more linear motors through the displacement of a working fluid, as described above, to realize one or more of controllability, precision, and/or continuity of pumped media flow according to embodiments of the present invention.

As will be obvious to one skilled in the art, numerous variations and modifications can be made to the embodiments disclosed above without departing from the spirit of the present invention.

What is claimed is:

1. A positive displacement pump comprising:

at least one pumped media pumping chamber comprising at least one deformable hydraulic diaphragm, wherein said at least one pumping chamber is fluidly connected to a common pumped media inlet end and a common pumped media outlet end;

inlet and outlet flow control valves in fluid connection with the inlet and outlet end of each said at least one pumping chamber;

a working fluid drive cylinder assembly having first and second ends and containing a working fluid;

a working fluid drive piston slidably situated within the working fluid drive cylinder between the first and second ends;

at least one electromagnetic linear motor attached to the working fluid drive piston such that a linear reciprocating motion of said linear motor drives a reciprocating motion of said working fluid drive piston within said working fluid drive cylinder assembly; and at least one working fluid compression jacket enclosing at least a portion of said at least one pumping chamber wherein said at least one working fluid compression jacket contains a working fluid in fluid communication with said working fluid drive cylinder assembly such that a linear reciprocating motion of said working fluid drive piston driven by said at least one linear motor alternatingly applies a constrictive and an expansive force to said at least one deformable hydraulic diaphragm; and a non-transitory control module comprising a computer readable control program, wherein said linear reciprocating motion of said at least one linear motor is controlled electrically by said non-transitory control module according to said computer readable control program;

wherein said control program comprises computer readable instructions to control the linear motor to produce a varying driving motion of the working fluid drive piston such that a substantially constant pumped media inlet pressure is maintained at the common pumped media inlet end.

2. The positive displacement pump according to claim 1 further comprising:

first and second pumped media pumping chambers, wherein said first and second pumping chambers comprise first and second deformable hydraulic diaphragms respectively;

first and second fluid compression jackets enclosing at least a portion of said first and second pumping chambers containing said working fluid in fluid communication with said working fluid drive cylinder assembly, such that said reciprocating movement of said working fluid drive piston driven by said at least one linear motor alternatingly applies a constrictive and an expansive force to each of said first and second deformable hydraulic diaphragms in opposite phase to each other.

3. The positive displacement pump according to claim 2, wherein said first and second deformable hydraulic diaphragms comprise first and second deformable hose diaphragms.

4. The positive displacement pump according to claim 1 wherein said substantially constant pumped media inlet pressure is greater than or equal to a net positive suction head pressure for a pumped media.

5. The positive displacement pump according to claim 1 wherein said control program comprises computer readable instructions to generate a defined pumped media outlet pressure at said common pumped media outlet end.

6. The positive displacement pump according to claim 1 wherein said at least one pumping chamber comprising said deformable hydraulic diaphragm and said working fluid drive cylinder assembly are configured substantially coaxially in a linear orientation.

7. The positive displacement pump according to claim 3 wherein said first and second pumping chambers comprising said first and second deformable hose diaphragms and said working fluid drive cylinder assembly are configured substantially coaxially in a linear orientation.

8. The positive displacement pump according to claim 1 wherein said working fluid contained in said working fluid drive cylinder assembly comprises a first working fluid, and wherein the working fluid contained in said at least one working fluid compression jacket comprises a second working fluid, and wherein said first working fluid is in fluid communication with said second working fluid.

9. The positive displacement pump according to claim 8 additionally comprising a secondary hydraulic diaphragm separating said first working fluid from said second working fluid.

10. A positive displacement pump comprising:

At least one pumped media pumping chamber comprising at least one deformable hydraulic diaphragm, wherein said at least one pumping chamber is fluidly connected to an inlet end and an outlet end;

inlet and outlet flow control valves in fluid connection with the inlet and outlet end of each said at least one pumping chamber;

a working fluid drive cylinder assembly having first and second ends and containing a working fluid;

a working fluid drive piston slidably situated within the working fluid drive cylinder between the first and second ends;

at least one linear motor attached to the working fluid drive piston such that a linear reciprocating motion of said linear motor drives a reciprocating motion of said working fluid drive piston within said working fluid drive cylinder assembly;

at least one fluid compression jacket enclosing at least a portion of said at least one pumping chamber wherein said at least one working fluid compression jacket contains a working fluid in fluid communication with said working fluid drive cylinder assembly such that a linear reciprocating motion of said working fluid drive piston driven by said at least one linear motor alternatingly applies a constrictive and an expansive force to said at least one deformable hydraulic diaphragm;

wherein said at least one linear motor comprises at least one electromagnetic linear motor, said positive displacement pump additionally comprising a non-transitory control module comprising a computer readable control program, wherein said linear reciprocating motion of said at least one linear motor is controlled electrically by said non-transitory control module according to said computer readable control program; and wherein said control program comprises computer readable instructions to control the linear motor to produce a linear driving motion with a linear motion velocity profile based on a rheological profile of the pumped media, such that a varying flow rate of pumped media is maintained through the positive displacement pump.

11. The positive displacement pump according to claim 10 further comprising:

first and second media pumping chambers, wherein said first and second pumping chambers comprise first and second deformable hydraulic diaphragms respectively;

first and second fluid compression jackets enclosing at least a portion of said first and second pumping chambers in fluid communication with said working fluid drive cylinder assembly, such that said reciprocating movement of said working fluid drive piston driven by said at least one linear motor alternatingly applies a constrictive and an expansive force to each of said first and second deformable hydraulic diaphragms in opposite phase to each other.

12. The positive displacement pump according to claim 11, wherein said first and second deformable hydraulic diaphragms comprise first and second deformable hose diaphragms.

13. The positive displacement pump according to claim 1 wherein said control program comprises computer readable instructions to generate a defined pumped media outlet pressure at said common pumped media outlet end.

14. The positive displacement pump according to claim 10 wherein said at least one pumping chamber comprising said deformable hydraulic diaphragm and said working fluid drive cylinder assembly are configured substantially coaxially in a linear orientation.

15. The positive displacement pump according to claim 12 wherein said first and second pumping chambers comprising said first and second deformable hose diaphragms and said working fluid drive cylinder assembly are configured substantially coaxially in a linear orientation.

16. The positive displacement pump according to claim 10 wherein said working fluid contained in said working fluid drive cylinder assembly comprises a first working fluid, and wherein the working fluid contained in said at least one working fluid compression jacket comprises a second working fluid, and wherein said first working fluid is in fluid communication with said second working fluid.

17. The positive displacement pump according to claim 16 additionally comprising a secondary hydraulic pump separating said first working fluid from said second working fluid.

18. The positive displacement pump according to claim 10 wherein said varying linear velocity profile corresponds to a pumped media discharge profile.

* * * * *